US011305973B2

(12) United States Patent
Chang

(10) Patent No.: US 11,305,973 B2
(45) Date of Patent: Apr. 19, 2022

(54) TRANSPORTATION APPARATUS

(71) Applicant: Chih-Feng Chang, Tainan (TW)

(72) Inventor: Chih-Feng Chang, Tainan (TW)

( * ) Notice: Subject to any disclaimer, the term of this patent is extended or adjusted under 35 U.S.C. 154(b) by 320 days.

(21) Appl. No.: 16/555,464

(22) Filed: Aug. 29, 2019

(65) Prior Publication Data

US 2020/0071143 A1 Mar. 5, 2020

(30) Foreign Application Priority Data

Aug. 30, 2018 (TW) ..... 107130397

(51) Int. Cl.

| | |
|---|---|
| ***B66F 9/07*** | (2006.01) |
| ***B66F 9/08*** | (2006.01) |
| ***B66F 9/12*** | (2006.01) |
| ***B66F 9/20*** | (2006.01) |
| ***B66F 9/16*** | (2006.01) |
| ***B66F 9/075*** | (2006.01) |

(52) U.S. Cl.

CPC ..... *B66F 9/072* (2013.01); *B66F 9/07504* (2013.01); *B66F 9/08* (2013.01); *B66F 9/125* (2013.01); *B66F 9/16* (2013.01); *B66F 9/20* (2013.01); *B66F 2700/09* (2013.01)

(58) Field of Classification Search

CPC ..... B66F 9/08; B66F 9/072; B66F 9/07504; B66F 9/125; B66F 9/16; B66F 9/20; B66F 2700/09

See application file for complete search history.

(56) References Cited

U.S. PATENT DOCUMENTS

| | | | | |
|---|---|---|---|---|
| 2,514,307 A * | 7/1950 | Boyd | B66C 1/24 | 294/67.21 |
| 2,757,035 A * | 7/1956 | Buehler | B66C 1/26 | 294/67.2 |
| 4,078,269 A * | 3/1978 | Weipert | A61G 3/006 | 5/611 |
| 4,541,134 A * | 9/1985 | Black | F16F 15/027 | 248/421 |

(Continued)

FOREIGN PATENT DOCUMENTS

FR 2584694 A1 * 1/1987 ..... B66B 9/04

OTHER PUBLICATIONS

Rogi Richard, FR-2584694-A1, published Jan. 16, 1987, English language machine translation retrieved from espacenet on Aug. 12, 2021 (Year: 1987).*

*Primary Examiner* — Saul Rodriguez
*Assistant Examiner* — Ashley K Romano
(74) *Attorney, Agent, or Firm* — Muncy, Geissler, Olds & Lowe, P.C.

(57) ABSTRACT

A transportation apparatus includes a delivering device, an elevating unit and a loading device. The delivering device is horizontally movable. The elevating unit is disposed under and mounted to the delivering device, and is vertically extendable and contractible relative to the delivering device. The loading device is adapted for loading and unloading an object, and includes a moving unit and a fork unit. The moving unit includes a moving base horizontally movable along a lower first axis parallel to a first direction relative to the elevating unit. The fork unit includes two fork prongs being horizontally spaced apart from each other along a second direction which is transverse to the first direction.

12 Claims, 11 Drawing Sheets

(56) References Cited

U.S. PATENT DOCUMENTS 4,655,466 A * 4/1987 Hanaoka ..... B62B 3/02 108/145
5,188,503 A * 2/1993 Appelberg ..... B21D 43/006 211/49.1
5,454,625 A * 10/1995 Christensen ..... B62B 3/08 187/244
5,829,948 A * 11/1998 Becklund ..... B66F 7/08 414/607
6,024,528 A * 2/2000 Taylor ..... A61G 1/06 296/20
6,511,080 B2 * 1/2003 Lee ..... B62B 3/0618 280/43.12
6,857,493 B2 * 2/2005 Shupp ..... B60T 7/16 180/168
6,910,710 B2 * 6/2005 Nguyen ..... B62B 3/02 280/47.371
D535,491 S * 1/2007 Wise ..... D6/684
8,191,865 B2 * 6/2012 Polins ..... B66F 7/28 254/122
9,371,217 B1 * 6/2016 DePumpo ..... B66F 9/07568
10,000,368 B2 * 6/2018 Haddix, II ..... B66C 1/28
10,464,463 B2 * 11/2019 Beiler ..... B62D 51/04
10,843,616 B2 * 11/2020 Lai ..... B66F 7/065
2006/0086569 A1 * 4/2006 Brown ..... A01M 31/02 182/63.1
2006/0180400 A1 * 8/2006 Schonauer ..... B60N 3/002 187/222
2006/0180401 A1 * 8/2006 Bourgeois ..... B66B 9/0861 187/250
2008/0095578 A1 * 4/2008 Farber ..... B66F 9/08 405/3
2010/0031845 A1 * 2/2010 Cardoni ..... B66F 9/07559 104/118
2010/0068023 A1 * 3/2010 Kuck ..... B66F 9/06 414/663
2013/0022434 A1 * 1/2013 Uttech ..... B66F 9/065 414/495
2019/0111649 A1 * 4/2019 Johnson ..... B25J 9/0087
2020/0071144 A1 * 3/2020 Draayer ..... B66F 9/07504
2020/0309589 A1 * 10/2020 Sukalski ..... G01G 19/083
2020/0385252 A1 * 12/2020 Zhang ..... B66F 9/122
2020/0385254 A1 * 12/2020 Dai ..... B66F 9/07
2020/0385255 A1 * 12/2020 Ruault ..... B66F 9/07509
2021/0139303 A1 * 5/2021 Rosencrance ..... B66F 11/042

* cited by examiner

TRANSPORTATION APPARATUS

CROSS-REFERENCE TO RELATED APPLICATION

This application claims priority of Taiwanese Patent Application No. 107130397, filed on Aug. 30, 2018.

FIELD

The disclosure relates to a transportation apparatus, and more particularly to a transportation apparatus adapted for delivering objects.

BACKGROUND

In traditional manufacturing, a product usually goes through multiple manufacturing processes before its completion, and these processes usually involve in-between procedures such as pick-and-place and transportation of materials. For example, during the process of making screws and nuts, intermediate or final products yielded from a molding machine are usually stored in a material box. The material box is then moved to a storage rack once a predetermined quantity of products is met. Later, the material box is retrieved from the storage rack and transported to a predetermined location when the products need to be further processed, tested, exported, etc.

In order to transport the material box, which has become heavily loaded, an operator may use a transportation apparatus such as a forklift, which provides horizontal transportation for the material box. However, since the forklifts are relatively large in size, the forklifts are restricted from accessing certain places, such as a narrow passageway. Therefore, an overhead crane (or other apparatus of the like) may be used to transfer the material box to sites that are not forklift-accessible. Moreover, the overhead crane can provide vertical transportation for the material box to relatively high places. Nevertheless, the overhead crane cannot replace the forklift, nor vice versa, due to their distinctive functionalities. In other words, the operators often need to switch between these two types of apparatus for transportation of the material box, which can easily become troublesome and inefficient in a large-scaled manufacturing project. In addition, both types of apparatus are relatively large and take up a lot of space.

SUMMARY

Therefore, the object of the disclosure is to provide a transportation apparatus that can alleviate at least one of the drawbacks of the prior art.

According to the disclosure, a transportation apparatus includes a delivering device, an elevating unit, and a loading device. The delivering device is horizontally movable. The elevating unit is disposed under and mounted to the delivering device, and is vertically extendable and contractible relative to the delivering device. The loading device is adapted for loading and unloading an object, and includes a frame unit, a moving unit and a fork unit. The frame unit includes a connecting base disposed under and mounted to the elevating unit. The moving unit is disposed under and mounted to the connecting base, and includes a moving base horizontally movable along a lower first axis parallel to a first direction relative to the connecting base. The fork unit includes two fork prongs being horizontally spaced apart from each other along a second direction which is transverse to the first direction, and being mounted to the moving base.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
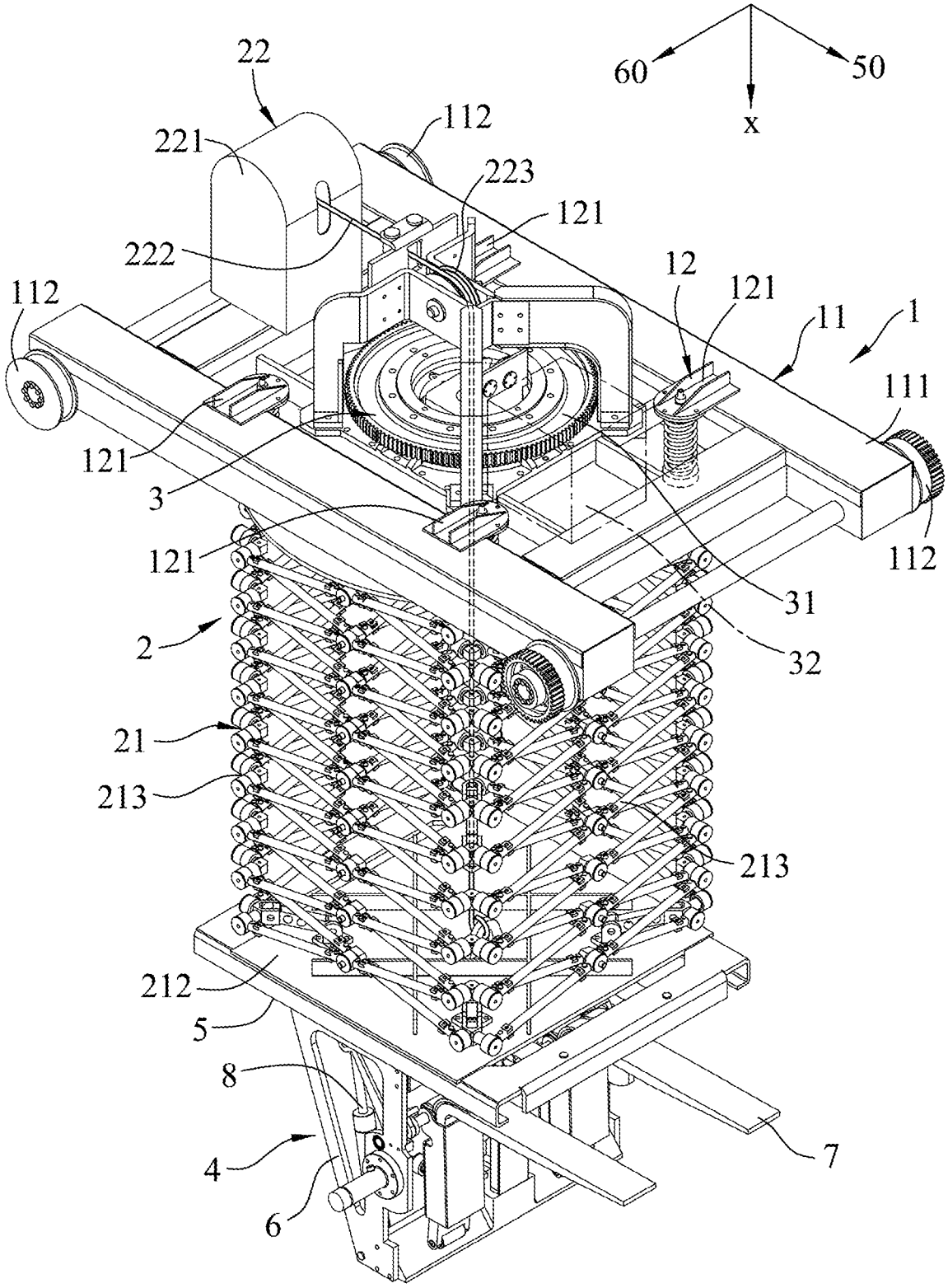
FIG. 1 is a perspective view of an embodiment of a transportation apparatus according to the present disclosure.
Figure 2:
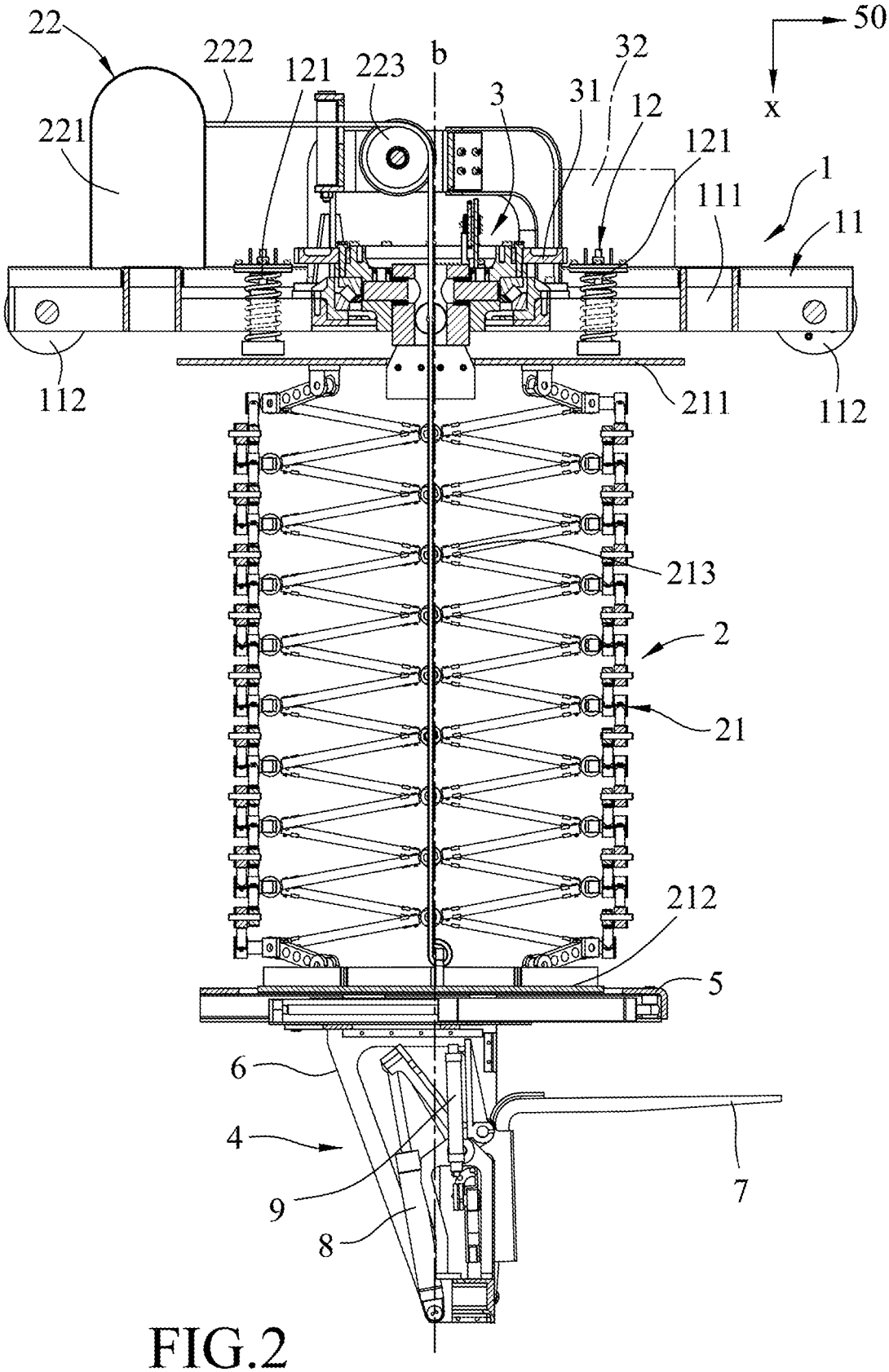
FIG. 2 is a sectional side view of the embodiment.

Referring to FIGS. 1 and 2, an embodiment of a transportation apparatus according to the present disclosure is adapted to be mounted slidably onto a movable overhead crane track (not shown). The transportation apparatus is slidable along an axis transverse to a moving direction of the overhead crane track. In other embodiments of the disclosure, the overhead crane track may be immovable. The transportation apparatus is adapted for loading and unloading an object (not shown). The object may include a material box, and a plurality of materials stored in the material box. The materials may be, but are not limited to, fasteners such as nuts and bolts, tooling, or structural elements. The material box may also be empty without any materials stored therein.

The transportation apparatus includes a delivering device 1, an elevating device 2, a rotary device 3, and a loading device 4. The delivering device 1 is horizontally movable. The elevating device 2 includes an elevating unit 21 that is disposed under and mounted to the delivering device 1, and that is vertically extendable and contractible relative to the delivering device 1. The rotary device 3 is mounted to the delivering device 1, and is operable for rotating the elevating unit 21. The loading device 4 is disposed under and mounted to the elevating unit 21, and is adapted for loading and unloading the object.

The delivering device 1 includes a sliding unit 11 and a damping unit 12. The sliding unit 11 includes a sliding base 111 and a plurality of rolling wheels 112 rotatably mounted to two opposite sides of the sliding base 111. The damping unit 12 includes four spaced-apart shock-absorbing bumpers 121 mounted to the sliding base 111 of the sliding unit 11 for absorbing impacts transferred from the elevating device 2. In other embodiments of the disclosure, the delivering device 1 may further include a control unit (not shown) for controlling the movement of the delivering device 1. However, the control unit is not of the main focus of the disclosure, and will not be described hereinafter.

In this embodiment, the elevating unit 21 of the elevating device 2 includes an upper base 211, a lower base 212 and four scissors units 213. The upper base 211 is mounted to the delivering device 1. The lower base 212 is disposed under the upper base 211, is mounted to the loading device 4, and is movable along a first vertical axis (b) parallel to an up-down direction (X) relative to the upper base 211. The four scissors units 213 interconnect the upper base 211 and the lower base 212, and are expanded or contracted during the movement of the lower base 212 along the first vertical axis (b) to ensure that the lower base 212 can move smoothly. It should be noted that the quantity of the scissors unit 213 is not limited to four, and it may be one, two, etc., in other embodiments of the disclosure.

The elevating device 2 further includes a hoist 22 including a rope reel 221 that is mounted to the delivering device 1, a rope 222 that is connected between the rope reel 221 and the lower base 212, and a guiding wheel 223 that is mounted to the delivering device 1 for guiding the rope 222 released from the rope reel 221 towards the loading device 4. The rope reel 221 is operable to release or to retract the rope 222 to thereby move the lower base 212 to result in the expansion or contraction of the scissors units 213.

The rotary device 3 includes a gear unit 31 and a driver unit 32. The gear unit 31 is connected to the elevating unit 21, and is rotatable about its own axis extending along the up-down direction (X). The driver unit 32 is mounted to the delivering device 1 for driving the rotation of the gear unit 31.

Figure 3:
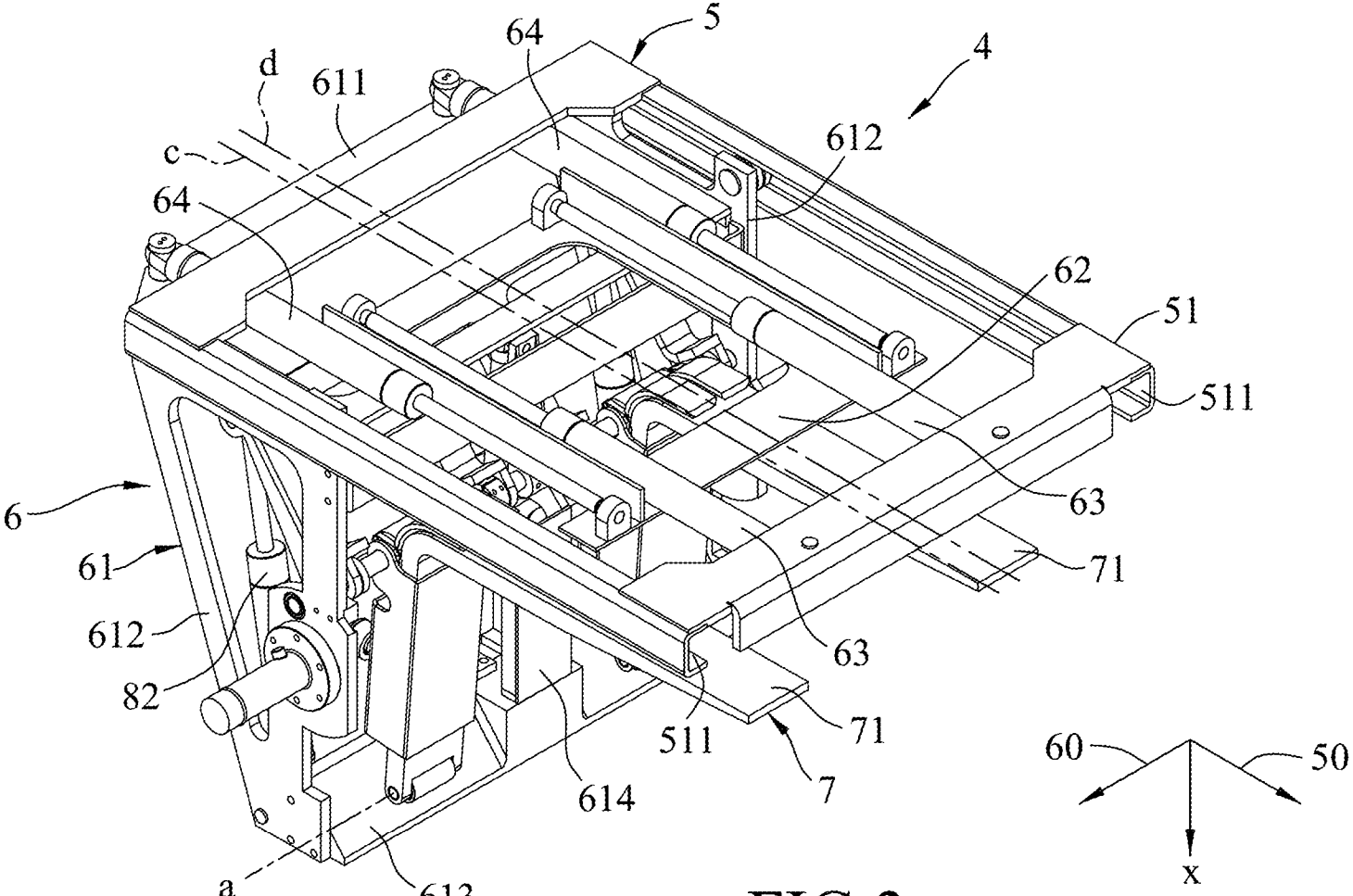
FIG. 3 is an assembled perspective view of a loading device of the embodiment, illustrating a moving base in a default position.
Figure 4:
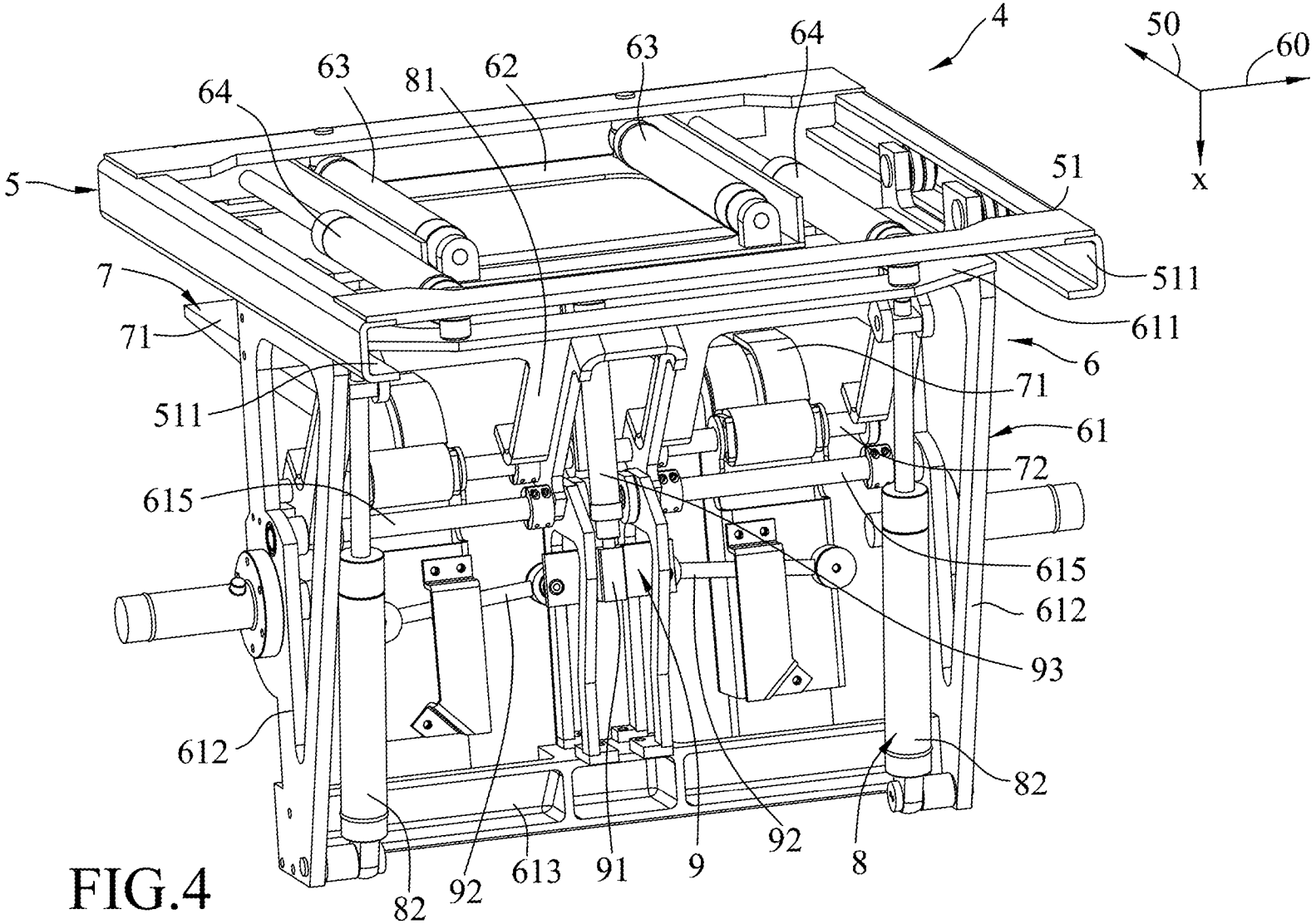
FIG. 4 is another assembled perspective view of the loading device of the embodiment.
Figure 5:
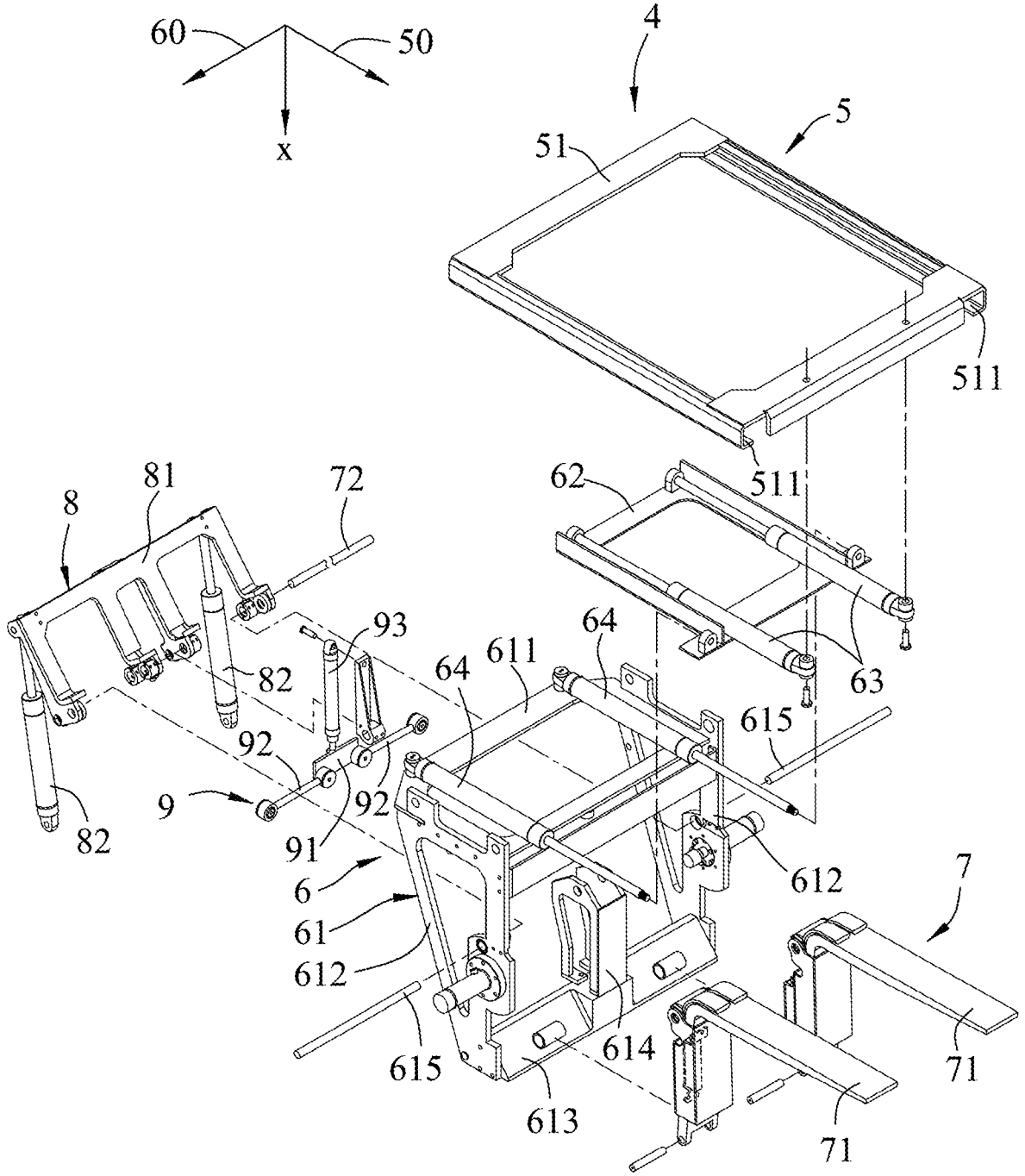
FIG. 5 is a partially exploded perspective view of the loading device of the embodiment.

Referring to FIGS. 3, 4 and 5, the loading device 4 includes a frame unit 5, a moving unit 6, a fork unit 7, a pivot unit 8 and a spacing unit 9. The frame unit 5 includes a connecting base 51 disposed under and mounted to the elevating unit 21 (shown in FIG. 1). The connecting base 51 is formed with two grooves 511 that are spaced apart along a second direction 60 which is transverse to the up-down direction (X), and that extend along a first direction 50 which is transverse to the up-down direction (X) and the second direction (60).

In this embodiment, the moving unit 6 of the loading device 4 is disposed under and mounted to the connecting base 51, and includes a moving base 61, a middle board 62, two first gas springs 63, and two second gas springs 64. The moving base 61 is horizontally movable along a lower first axis (c) parallel to the first direction 50 relative to the connecting base 51, and includes a top member 611, two side members 612, a bottom member 613, a middle member 614, and two shafts 615. The two side members 612 are respectively connected to two opposite ends of the top member 611 along the second direction 60. A top portion of each of the side members 612 engages slidably a respective one of the grooves 511 of the connecting base 51, so that the top member 611 is mounted to the connecting base 51 via the side members 612. The bottom member 613 is connected between bottom portions of the side members 612. The middle member 614 extends upwardly from a center of the bottom member 613. The two shafts 615 extend along the second direction 60, and each interconnects the middle member 614 and a respective one of the side members 612. The middle board 62 is disposed between the connecting base 51 and the top member 611. The two first gas springs 63 are mounted between the connecting base 51 and the middle board 62, and are extendable and contractible to move the middle board 62 along an upper first axis (d) parallel to the first direction 50 relative to the connecting base 51. The two second gas springs 64 are mounted between the middle board 62 and the top member 611, and are extendable and contractible to move the moving base 61 along the lower first axis (c). It should be noted that, the quantities of the first and second gas springs 63, 64 are not limited to two, and may vary in other embodiments of the disclosure.

The fork unit 7 of the loading device 4 includes two fork prongs 71 and a connecting rod 72. The two fork prongs 71 are horizontally spaced apart from each other along the second direction (60), and are connected pivotally to the bottom member 613 of the moving base 61. Each of the fork prongs 71 is invertedly L-shaped. However, in other embodiments of the disclosure, the fork prongs 71 may be L-shaped.

In this embodiment, the pivot unit 8 of the loading device 4 includes a pivot base 81 and two pivot gas springs 82. The pivot base 81 is pivotally mounted to the shafts 615 of the moving unit 6, and the pivot gas springs 82 pivotally interconnect the moving unit 6 and the pivot base 81. The connecting rod 72 of the fork unit 7 pivotally connects the fork prongs 71 of the fork unit 7 to the pivot base 81, such that operation of the pivot gas springs 82 drives a pivot movement of the pivot base 81, thereby resulting in a pivot movement of the fork unit 7 about a pivot axis (a) extending along the second direction 60. It should be noted that, the quantity of the pivot gas springs 82 is not limited to two, and may vary in other embodiments of the disclosure.

The spacing unit 9 of the loading device 4 includes a sliding block 91, two linking rods 92 and a spacing gas spring 93. The sliding block 91 is movable along a second vertical axis (e) parallel to the up-down direction (X) relative to the moving unit 6. Each of the linking rods 92 pivotally interconnects the sliding block 91 and a respective one of the fork prongs 71 of the fork unit 7. The spacing gas spring 93 is disposed for driving the movement of the sliding block 91 along the second vertical axis (e) such that operation of the spacing gas spring 93 adjusts a distance between the fork prongs 71 along the second direction 60.

Referring to FIGS. 1 and 2, during operation, a user may control and move the overhead crane track and the delivering device 1 horizontally toward the object to be transported. Then, the user may control the rotary device 3 to rotate the elevating unit 21 of the elevating device 2 and the loading device 4 so that the fork unit 7 of the loading device 4 is facing the object. Next, the hoist 22 of the elevating device 2 can be operated to release or contract the rope 222 to thereby drive the elevating unit 21 to extend or to contract until the fork unit 7 is level with the object, so that the loading device 4 is finely adjusted to load the object.

Figure 6:
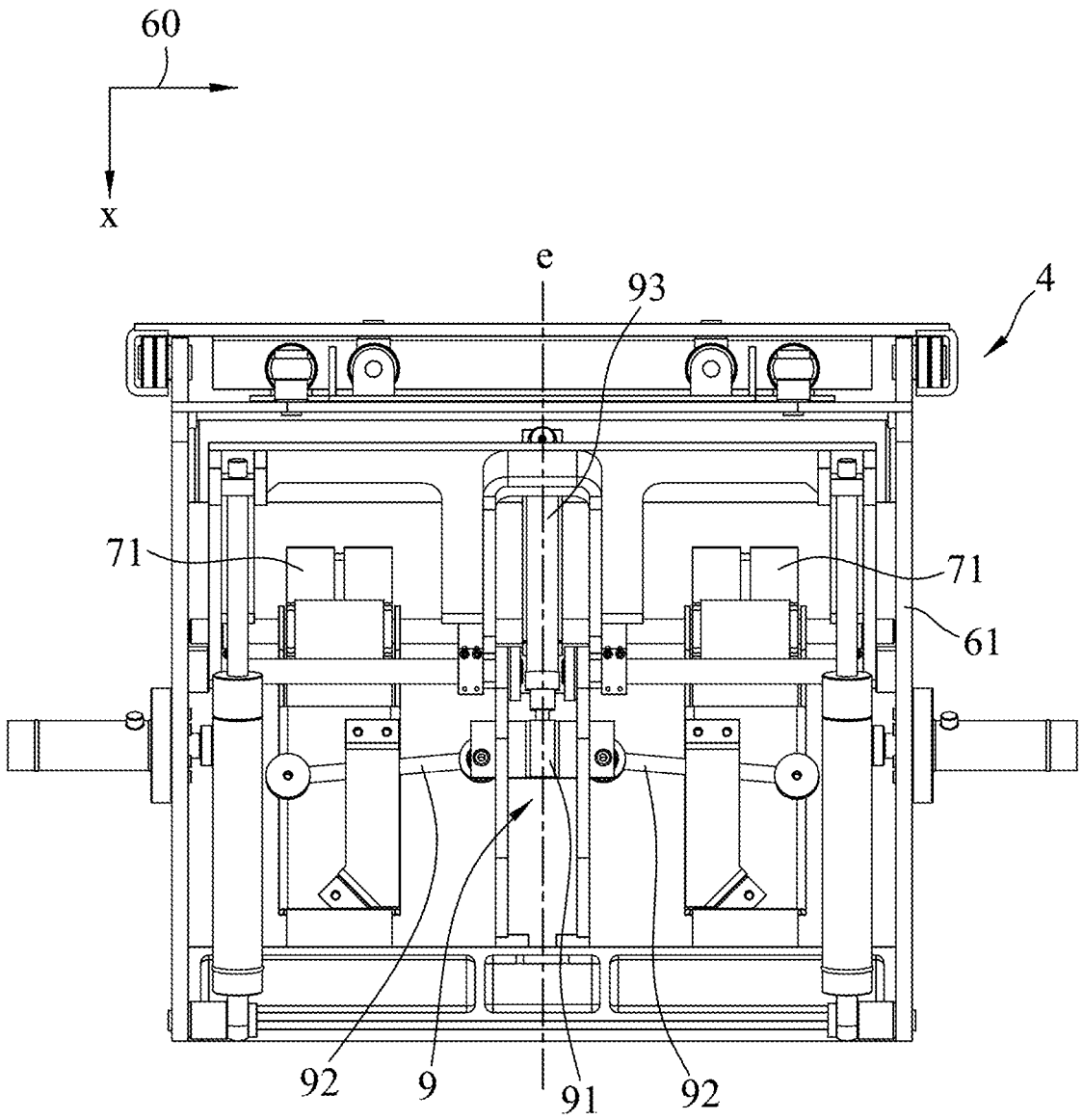
FIG. 6 is a rear view of the loading device of the embodiment, illustrating two fork prongs in an open position.
Figure 7:
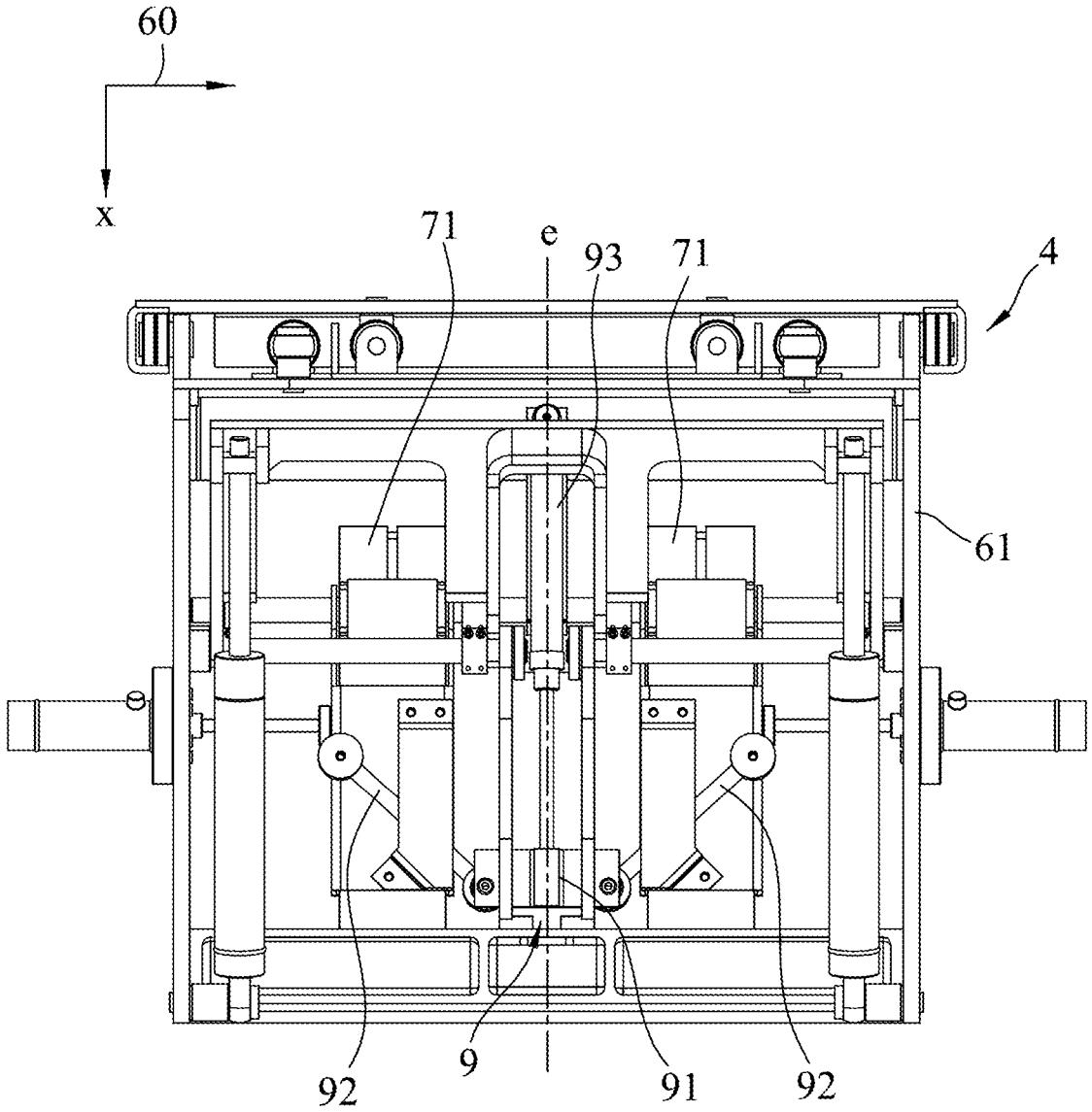
FIG. 7 is another rear view of the loading device of the embodiment, illustrating the fork prongs in a closed position.

Referring to FIGS. 6 and 7, depending on a size of the object, the loading device 4 is operable to adjust a distance between the fork prongs 71 via the spacing unit 9. By driving the spacing gas spring 93, the sliding block 91 is moved upward or downward, so that the linking rods 92 drive the fork prongs 71 to move away from or toward each other along the pivot axis (a). More specifically, the fork prongs 71 are convertible between an open position (see FIG. 6), where the fork prongs 71 are distal from each other, and a closed position (see FIG. 7), where the fork prongs 71 are proximate to each other.

Figure 8:
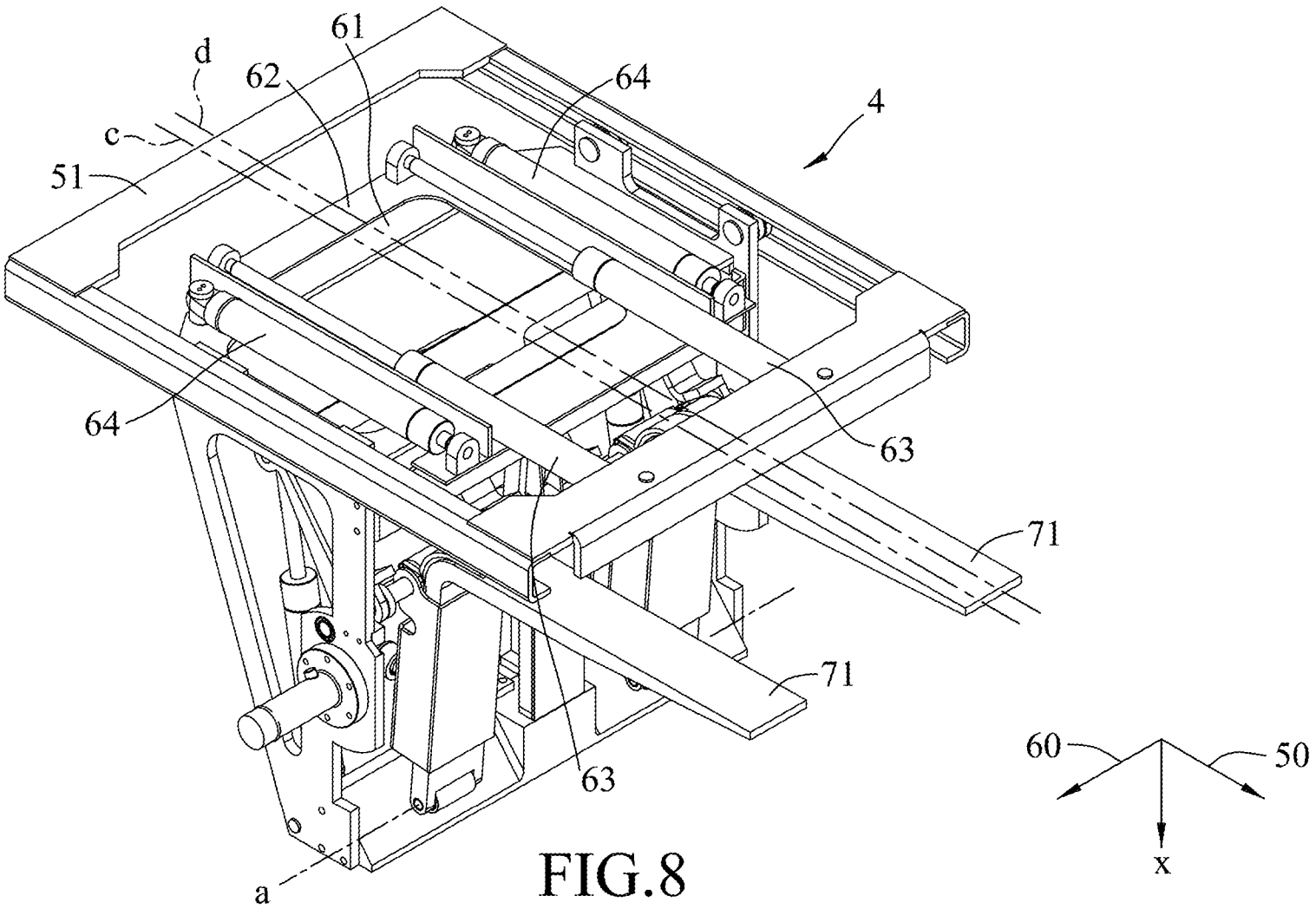
FIG. 8 is yet another assembled perspective view of the loading device of the embodiment, illustrating the moving base in a half-extended position.
Figure 9:
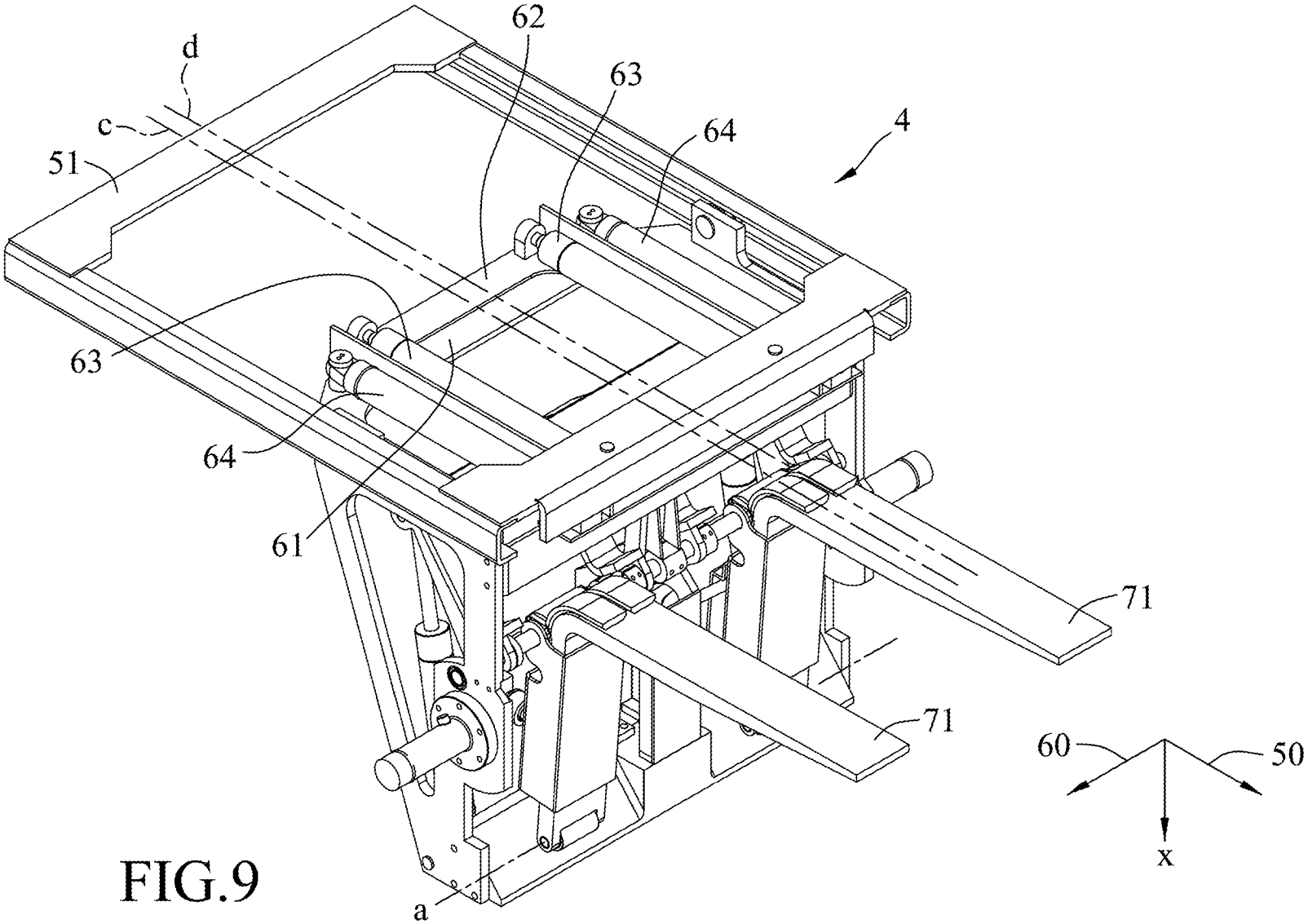
FIG. 9 is yet another assembled perspective view of the loading device of the embodiment, illustrating the moving base in a fully-extended position.

Referring to FIGS. 3, 8 and 9, after adjusting the distance between the fork prongs 71, the loading device 4 is then operable to adjust the position of the fork prongs 71 relative to the connecting base 51 via the moving unit 6, so that the fork prongs 71 may be moved underneath the object for loading. By driving the first gas springs 63 and the second gas springs 64 to contract or to extend, the middle board 62 and the moving base 61 are driven to move along the upper and lower first axes (d, c), so that the moving base 61 is converted among a default position, a half-extended position and a fully-extended position relative to the connecting base 51.

In the default position as shown in FIG. 3, the first gas springs 63 and the second gas springs 64 are all extended. The middle board 62 is underneath the connecting base 51, and a center of the middle board 62 is substantially aligned with that of the connecting base 51. The moving base 61 is moved underneath a side portion of the connecting base 51, is slightly offset from the center of the middle board 62, and is distal from the object. The fork prongs 71 are not extended out from underneath the connecting base 51. In the half-extended position as shown in FIG. 8, the first gas springs 63 are extended and the second gas springs 64 are contracted. The moving base 61 is driven to move along the first direction 50, and is substantially underneath the center of the middle board 62. The fork prongs 71 are partially extended out from underneath the connecting base 51. In the fully-extended position as shown in FIG. 9, the first gas springs 63 and the second gas springs 64 are all contracted. The middle board 62 is driven to move along the first direction to be underneath another side portion of the connecting base 51. The moving base 61 remains substantially underneath the center of the middle board 62. The fork prongs 71 are extended out from underneath the connecting base 51, and are ready to load the object.

Figure 10:
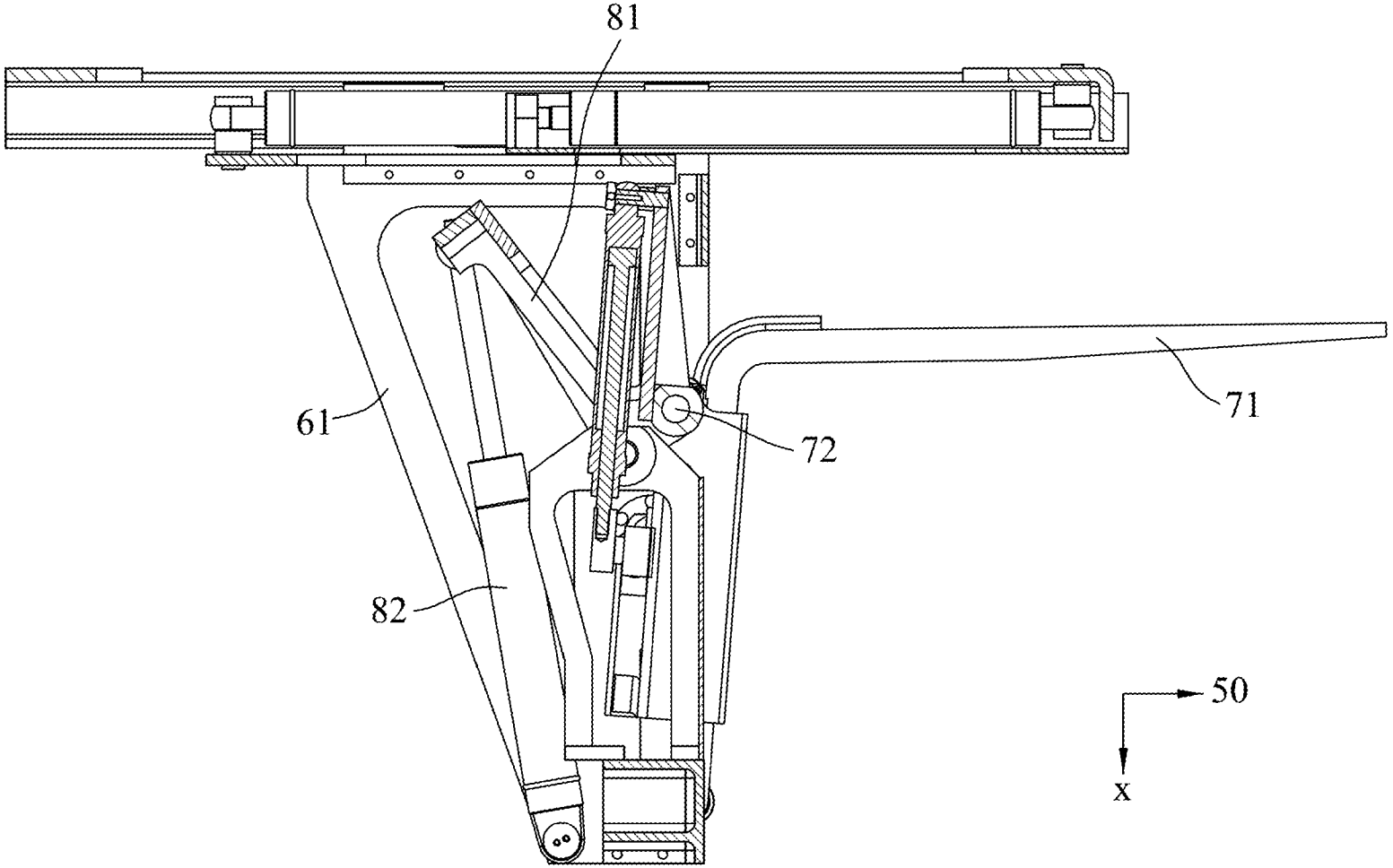
FIG. 10 is a sectional side view of the loading device of the embodiment, illustrating the fork prongs in a horizontal position.
Figure 11:
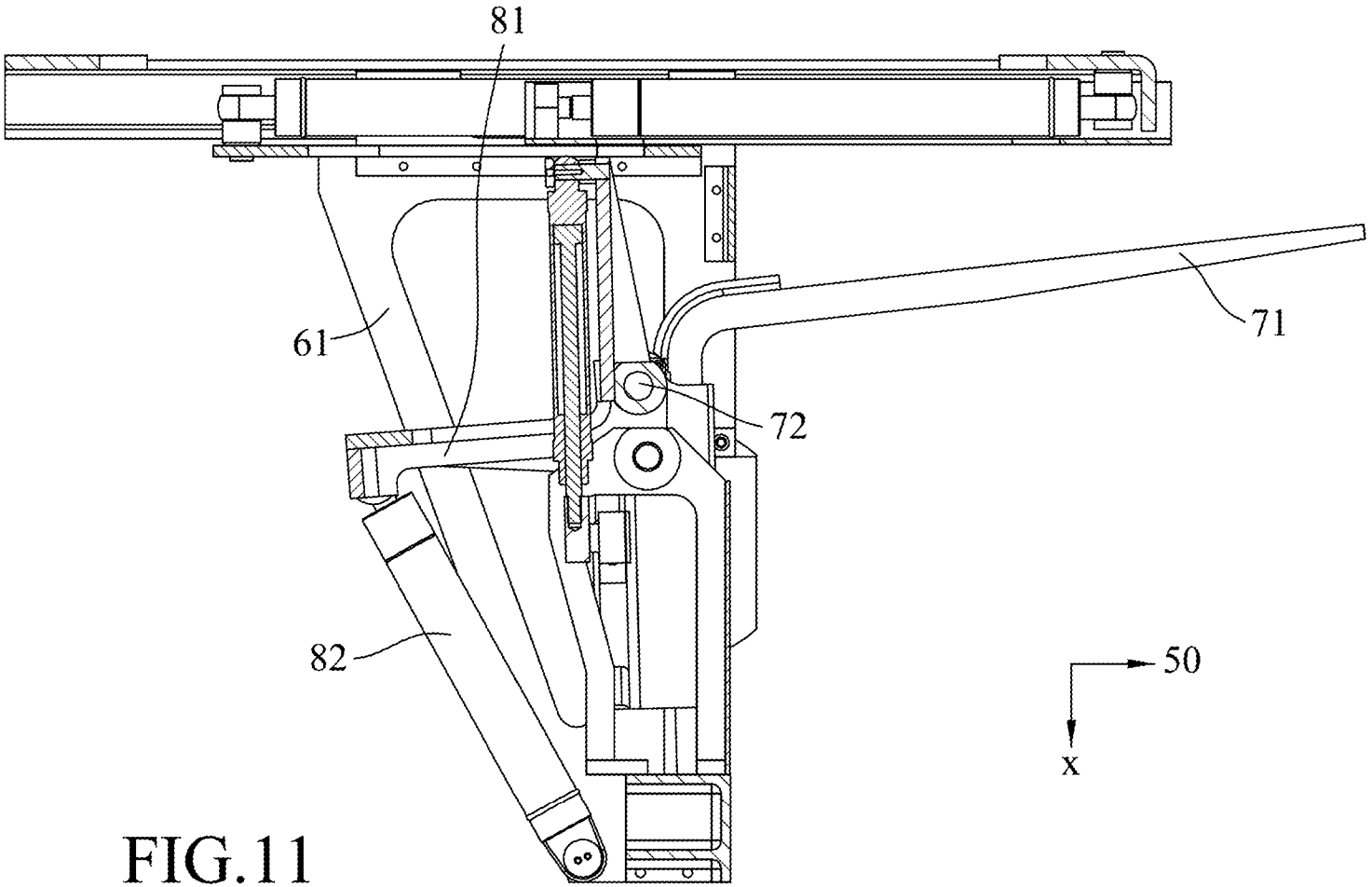
FIG. 11 is another sectional side view of the loading device of the embodiment, illustrating the fork prongs in a tilted position.

Referring to FIGS. 4, 10 and 11, after the object is loaded onto the fork prongs 71, the pivot unit 8 is operable to adjust a tilt angle of the fork prongs 71 for preventing the object from falling off. By controlling the pivot gas spring 82 to extend or to contract, the pivot base 81 is pivoted and thereby moves the connecting rods 72, resulting in a pivot movement of the fork unit 7 about the pivot axis (a). In such a manner, the fork prongs 71 are converted between a horizontal position (see FIG. 10) and a tilted position (see FIG. 11) relative to the moving base 61.

Finally, referring back to FIGS. 1 and 2, the delivering device 1 may be controlled to move to a desired location to unload the object. The user may unload the object by following abovementioned instructions in a reverse order, and a transporting process may be completed.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A transportation apparatus comprising:

a delivering device being horizontally movable;

an elevating unit disposed under and mounted to said delivering device, and being vertically extendable and contractible relative to said delivering device;

a loading device adapted for loading and unloading an object, and including a frame unit that includes a connecting base disposed under and mounted to said elevating unit, a moving unit that is disposed under and mounted to said connecting base, and that includes a moving base horizontally movable along a lower first axis parallel to a first direction relative to said connecting base, and a fork unit that includes two fork prongs being horizontally spaced apart from each other along a second direction which is transverse to the first direction, and mounted to said moving base; and a rotary device mounted to said delivering device and operable for rotating said elevating unit.

2. The transportation apparatus as claimed in claim 1, wherein said rotary device includes a gear unit that is connected to said elevating unit, and that is rotatable about its own axis extending along an up-down direction which is transverse to the first and second directions, and a driver unit that is mounted to said delivering device for driving the rotation of said gear unit.

3. The transportation apparatus as claimed in claim 1, wherein said fork unit is pivotable about a pivot axis extending along the second direction.

4. The transportation apparatus as claimed in claim 3, wherein:

said loading device further includes a pivot unit that includes a pivot base pivotally mounted to said moving unit, and at least one pivot gas spring pivotally interconnecting said moving unit and said pivot base; and said fork unit of said loading device further includes a connecting rod that pivotally connects said fork prongs to said pivot base, such that operation of said at least one pivot gas spring drives a pivot movement of said pivot base, thereby resulting in a pivot movement of said fork unit about the pivot axis.

5. The transportation apparatus as claimed in claim 4, wherein said loading device further includes a spacing unit that includes:

a sliding block movable along a second vertical axis parallel to the up-down direction relative to said moving unit; two linking rods each pivotally interconnecting said sliding block and a respective one of said fork prongs; and a spacing gas spring for driving the movement of said sliding block along the second vertical axis such that operation of said spacing gas spring adjusts a distance between said fork prongs along the second direction.

6. The transportation apparatus as claimed in claim 5, wherein:

said moving base includes a top member mounted to said connecting base, two side members respectively connected to two opposite ends of said top member along the second direction, a bottom member connected between bottom portions of said side members, said fork prongs being connected pivotally to said bottom member, a middle member extending upwardly from a center of said bottom member, and two shafts extending along the second direction, and each interconnecting said middle member and a respective one of said side members;

said pivot base of said pivot unit is pivotally mounted to said shafts; and said moving unit further includes a middle board disposed between said connecting base and said top member, at least one first gas spring mounted between said connecting base and said middle board, and being extendable and contractible to move said middle board along an upper first axis parallel to the first direction relative to said connecting base, and at least one second gas spring mounted between said middle board and said top member, and being extendable and contractible to move said moving base along the lower first axis.

7. The transportation apparatus as claimed in claim 6, wherein said connecting base of said frame unit is formed with two grooves that are spaced apart along the second direction and that extend along the first direction, a top portion of each of said side members engaging slidably a respective one of said grooves.

8. The transportation apparatus as claimed in claim 4, wherein:

said moving base includes a top member mounted to said connecting base, two side members respectively connected to two opposite ends of said top member along the second direction, a bottom member connected between bottom portions of said side members, said fork prongs being connected pivotally to said bottom member, a middle member extending upwardly from a center of said bottom member, and two shafts extending along the second direction, and each interconnecting said middle member and a respective one of said side members;

said pivot base of said pivot unit is pivotally mounted to said shafts; and said moving unit further includes a middle board disposed between said connecting base and said top member, at least one first gas spring mounted between said connecting base and said middle board, and being extendable and contractible to move said middle board along the upper first axis relative to said connecting base, and at least one second gas spring mounted between said middle board and said top member, and being extendable and contractible to move said moving base along the lower first axis.

9. The transportation apparatus as claimed in claim 8, wherein said connecting base of said frame unit is formed with two grooves that are spaced apart along the second direction and that extend along the first direction, a top portion of each of said side members engaging slidably a respective one of said grooves.

10. The transportation apparatus as claimed in claim 1, wherein said delivering device includes a sliding unit that includes a sliding base and a plurality of rolling wheels rotatably mounted to two opposite sides of said sliding base.

11. The transportation apparatus as claimed in claim 10, wherein said delivering device further includes a damping unit that includes four spaced-apart shock-absorbing bumpers mounted to said sliding base of said sliding unit.

12. The transportation apparatus as claimed in claim 1, wherein:

said elevating unit includes an upper base mounted to said delivering device, a lower base disposed under said upper base, mounted to said loading device, and movable along a first vertical axis parallel to the up-down direction relative to said upper base, and at least one scissors unit interconnecting said upper base and said lower base, and being expanded or contracted during the movement of said lower base along the first vertical axis;

said transportation apparatus further comprises a hoist including a rope reel that is mounted to said delivering device, a rope that is connected between said rope reel and said lower base, and a guiding wheel that is mounted to said delivering device for guiding said rope released from said rope reel towards said loading device; and said rope reel is operable to release or to retract said rope to thereby move said lower base to result in the expansion or contraction of said at least one scissors unit.

* * * * *